US006146129A

United States Patent [19]

Li

[11] Patent Number: 6,146,129

[45] Date of Patent: Nov. 14, 2000

[54] CIGARETTE LIGHTER SAFETY LOCKING DEVICE UTILIZING A SPRING BIASED LATCH

[75] Inventor: Xin-Liang Li, Arcadia, Calif.

[73] Assignee: A.S.G. Enterprise, Inc., Arcadia, Calif.

[21] Appl. No.: 09/432,832

[22] Filed: Nov. 2, 1999

[51] Int. Cl.[7] ..... F23D 11/36

[52] U.S. Cl. ..... 431/153; 431/255

[58] Field of Search ..... 431/153, 255

[56] References Cited

U.S. PATENT DOCUMENTS

| | | | |
|---|---|---|---|
| 5,145,358 | 9/1992 | Shike et al. | 431/153 |
| 5,462,432 | 10/1995 | Kim . | |
| 5,788,476 | 8/1998 | Sher | 431/153 |
| 5,839,892 | 11/1998 | Hwang . | |
| 5,885,069 | 3/1999 | Rogelet . | |

*Primary Examiner*—Carroll Dority

*Attorney, Agent, or Firm*—Thomas I. Rozsa; Tony D. Chen; Jerry Fong

[57] ABSTRACT

A cigarette lighter which has a safety locking device utilizing a spring biased latch. The cigarette lighter comprises a case, a top cover hingeably attached to an upper part of the case, a lighter seat, a press-down button, and the safety locking device. The latch is slidable mounted on top of the press-down button of the cigarette lighter. The latch is biased by an internal coil spring, which urges the latch to be engaged with the lighter seat, thereby preventing the press-down button from being pressed-down. When a user intends to use the cigarette lighter, the latch can be slid laterally against the spring force of the coil spring to disengage the latch from the lighter seat, thereby allowing the press-down button to be pressed down and ignite the cigarette lighter. Once the user releases the press-down button, it returns upwardly while the latch is biased back by the coil spring and automatically engages with the lighter seat again and thereby locks the press-down button.

17 Claims, 1 Drawing Sheet

CIGARETTE LIGHTER SAFETY LOCKING DEVICE UTILIZING A SPRING BIASED LATCH

BACKGROUND OF THE INVENTION

1. Field of the Invention

The present invention generally relates to the field of cigarette lighters. More particularly, the present invention relates to the field of safety locking mechanisms of cigarette lighters.

2. Description of the Prior Art

A typical conventional disposable cigarette lighter has a press-down button for ignition. In earlier lighters, there was no safety locking device for preventing the press-down button from being pressed down to ignite the cigarette lighter. Often times children play with cigarette lighters, and because of the lack of a safety locking device, they are able to ignite the cigarette lighter easily, which often causes accidental fires. It has been estimated by the United States Consumer Products Safety Commission ("CPSC") that there are as many as 150 deaths and over 1,000 injuries each year related to children under the age of 5 playing with cigarette lighters without safety locking devices.

The CPSC has imposed a new rule on all cigarette lighter manufacturers and importers, which became effective on Jul. 12, 1994. This new rule (codified as 16 C.F.R. § 1210) requires all disposable cigarette lighters sold in the United States to meet specified requirement for child-resistance. This means that cigarette lighters shall be resistant to successful operation by at least 85% of a child test panel consisting of up to 200 children living within the United States and distributed by age and sex.

Under the CPSC rule, the child-resistant mechanism in cigarette lighters must have the functions: (1) to reset itself automatically after each operation of the ignition mechanism of the cigarette lighter; (2) not to impair safe operation of the cigarette lighter when used in normal and conventional manner; (3) to be effective for the reasonably expected life of the cigarette lighter; and (4) not to be easily overridden or deactivated.

U.S. Pat. No. 5,462,432 issued to Kim on Oct. 31, 1995 for "Gas Lighter with Ignition Safety Device" discloses an ignition safety device in a gas lighter to reliably prevent ignition of the lighter when a safety button is in a locked position, and to allow ignition of the lighter when the safety button is moved to an unlocked position. The safety button has a projection with an end surface which is aligned with an end surface of a projection at the upper part of the lighter when the safety button is in the locked position and thereby prevents the ignition button to be pressed down so that the lighter cannot be ignited which provides the child safety feature. However, when the safety button is moved to the unlocked position, the end surfaces of the two projections are misaligned and thereby allows the ignition button to be pressed down to ignite the lighter.

U.S. Pat. No. 5,839,892 issued to Hwang on Nov. 24, 1998 for "Electronic Lighter with A Safety Device" discloses a lighter with a safety device having a seat provided on a top end of the gas container. The lighter has a press button with an upper cover and a press cylinder with matching hook-like ends. The hook-like ends of the upper cover are retained by a step portion near the upper ends of a pair of second guide slots located slightly to the back of a pair of first guide slots of an electrode plate of a piezo-electric element, so that the upper cover and press cylinder cannot be pressed down to ignite the lighter. After the upper cover is moved so that its hook-like ends lap over the hook-like ends of the press cylinder in the second guide slots, the upper cover and the press cylinder may be pressed downwardly to press a spring element to ignite the lighter.

U.S. Pat. No. 5,885,069 issued to Rogelet on Mar. 23, 1999 for "Lighter" discloses a lighter actuated by a push control member. The push control member has an abutment surface which is normally opposite to a counter-abutment surface in the lighter body to prevent the press control member to be pressed down. The press control member can be moved so that the respective abutment and counter-abutment surfaces of the press control member and the lighter are in a non-active position which allows the press control button to be pressed down.

It is desirable to design and construct a new and improved cigarette lighter safety locking device which not only makes the lighter child-resistant and thereby reduces the injuries and damages resulting from children playing with cigarette lighters, but also easy to use and simple in construction and design and thereby contains the cost of manufacturing the lighters with the added safety locking device.

SUMMARY OF THE INVENTION

The present invention is a refillable cigarette lighter safety locking device utilizing a spring biased latch.

It is therefore an object of the present invention to provide a cigarette lighter safety locking device which resets itself automatically after each operation of the ignition mechanism of the lighter.

It is also an object of the present invention to provide a cigarette lighter safety locking device which does not impair safe operation of the lighter when used in normal and conventional manner.

It is another object of the present invention to provide a cigarette lighter safety locking device which is effective for the reasonably expected life of the lighter.

It is an additional object of the present invention to provide a cigarette lighter safety locking device which cannot be easily overridden or deactivated.

It is a further object of the present invention to provide a cigarette lighter safety locking device which is simple in construction, low costs and easy to use.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
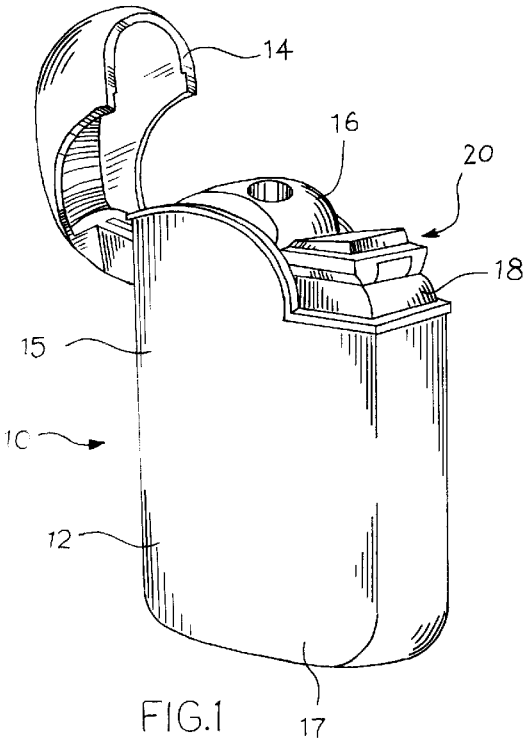
FIG. 1 is a perspective view of a cigarette lighter equipped with the present invention safety locking device utilizing a spring biased latch.

Referring to FIG. 1, there is shown a perspective view of a refillable cigarette lighter 10 equipped with the present invention safety locking device 20. The cigarette lighter 10 has a case or body 12, a top cover 14, a lighter seat 16, a press-down button 18 and the safety locking device 20.

The case 12 of the lighter 10 has a top end 15 and a bottom end 17. The top cover 14 is hingeably attached to the top end 15 of the case 12 and covers the lighter seat 16, the press-down button 18 and the safety locking device 20.

Figure 3:
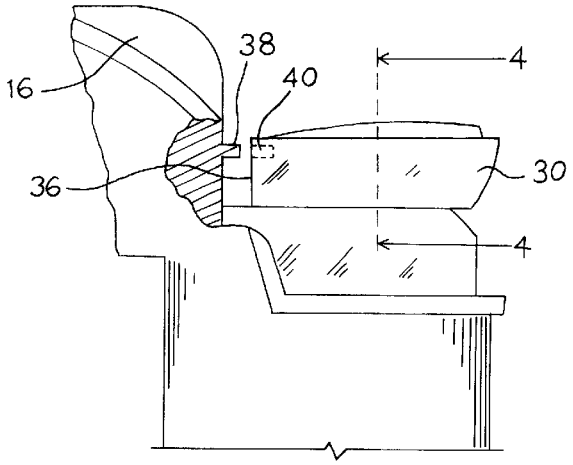
FIG. 3 is a partial side elevational view of the preferred embodiment of the present invention safety locking device utilizing a spring biased latch, showing in its unlocked or disengaged position.
Figure 2:
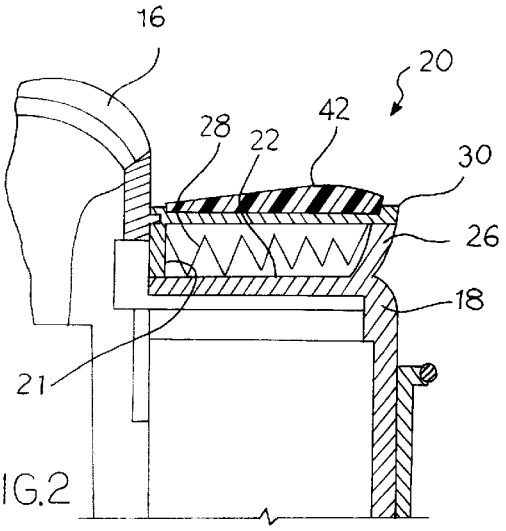
FIG. 2 is a partial cross-sectional view of a preferred embodiment of the present invention safety locking device utilizing a spring biased latch, showing in its locked or engaged position.
Figure 4:
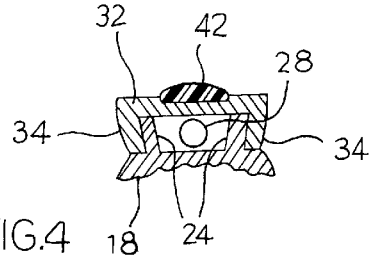
FIG. 4 is a partial cross-sectional view taken along line 4—4 of FIG. 3.

Referring to FIGS. 2, 3, and 4, there is shown a preferred embodiment of the present invention safety locking device 20. The press-down button 18 has a recess or channel 22 which is located on top of the press-down button 18. The recess 22 is formed by a pair of opposite rails or sidewalls 24, a distal end wall 26 and a proximal end opening.

The cigarette lighter safety locking device 20 utilizes a spring biased latch 30. The spring biased latch 30 is mounted on top of the press-down button 18 over the recess 22.

The spring biased latch 30 has a top plate 32 which covers the recess 22, a pair of opposite sidewalls 34 which are slidably engaged with the pair of rails 24 at the top of the press-down button 18, and a proximal end wall 21 which covers the proximal end opening of the recess 22 at the top of the press-down button 18.

An internal coil spring 28 is provided with the safety locking device 20 and is installed between the distal end wall 26 of the recess 22 and the proximal end wall 21 of the spring biased latch 30. The safety locking device 20 further include a protruding lock tongue 38 integrally formed on the sidewall 36 of the lighter seat 16, and a complementary socket or notch 40 on the proximal end wall 36 of the spring biased latch 30. When the protruding lock tongue 38 is inserted into the complementary socket or notch 40 as the latch 30 is biased by the spring 28, the press-down button 18 cannot be press-down to ignite the lighter 10.

A thumb piece means 42 is mounted on the top plate 32 of the spring biased latch 30 for facilitating the sliding of the latch 30. The thumb piece means 42 may be made of rubber material or any other suitable material. When the spring biased latch 30 is slid by a user against the spring bias, the protruding lock tongue 38 is disengaged from the complementary socket or notch 40, so that the press-down button 18 can be press-down to ignite the lighter 10.

The operation of the foregoing embodiment now will be described. The cigarette lighter 10 can be ignited by sliding the latch 30 laterally away from the lighter seat 16 and then pushing the press-down button 18 down to ignite the cigarette lighter 10. The latch 30 is slidably mounted on top of the press-down button 18 of the cigarette lighter 10. The latch 30 is biased by the internal coil spring 28, which urges the latch 30 to be butted against the lighter seat 16 such that the lock tongue 38 engages with the complementary socket 40, thereby preventing the press-down button 18 from being pressed down. This prevents the lighter 10 to be accidentally ignited by a child.

When an adult user intends to use the cigarette lighter 10, the latch 30 can be slid laterally against the bias of the spring 28 to disengage the lock tongue 38 from the socket 40, thereby allowing the press-down button 18 to be pressed down and ignite the cigarette lighter 10.

Once the user releases the press-down button 18, it returns upwardly while the latch 30 is biased back by the coil spring 28 and the lock tongue 38 automatically engages again with the socket 40 and thereby locks the press-down button 18.

Figure 5:
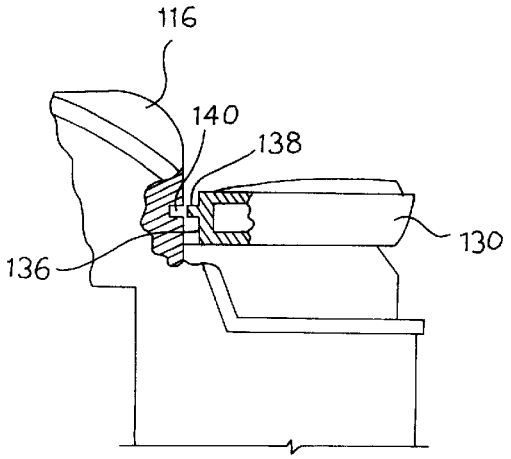
FIG. 5 is a partial cross-sectional view of an alternative embodiment of the present invention safety locking device utilizing a spring biased latch, showing in its unlocked or disengaged position.

It will be appreciated that the present invention safety locking device 20 is not limited to the lock tongue and socket arrangement as illustrated in FIGS. 2 through 4 for preventing the press-down button 18 from being pressed down. It is emphasized that while this arrangement is preferred, it is also within the spirit and scope of the present invention to reverse the lock tongue and socket arrangement as illustrated in FIG. 5, such that the protruding lock tongue 138 is integrally formed on the proximal end wall 136 of the spring biased latch 130, and the socket 140 is integrally formed on the lighter seat 116. In addition, it will not be too hard for one skilled in the art to replace the lock tongue and socket arrangement with any other type of engagement means which can make the cigarette lighter child-resistant, thereby reducing the injuries and damages resulting from children playing with the cigarette lighters.

The present invention conforms to conventional forms of manufacture, and is of simple construction and is easy to use.

The present invention has many advantageous features including: (a) the cigarette lighter safety locking device resets itself automatically after each operation of the ignition mechanism of the cigarette lighter; (b) the cigarette lighter safety locking device does not impair safe operation of the lighter when used in normal and conventional manner; (c) the cigarette lighter safety locking device is effective for the reasonably expected life of the lighter; and (d) the cigarette lighter safety locking device cannot be easily overridden or deactivated.

Defined in detail, the present invention is a refillable cigarette lighter, comprising: (a) a case having a bottom end and a top end; (b) a lighter seat mounted on said top end of said case and having a socket located at one side of the lighter seat; (c) a press-down button mounted on said top end of said case and located adjacent to said lighter seat, the press-down button having a pair of opposite sidewalls, a distal end wall, a proximal end opening and a recess located between the pair of opposite sidewalls; (d) a latch having a pair of opposite sidewalls, a proximal end wall and a top plate, the latch slidably mounted on top of said press-down button, where the pair of opposite sidewalls slidably engage with said pair of sidewalls of said press-down button and the proximal end wall covers said proximal end opening of said press-down button; (e) a protruding lock tongue integrally formed on said proximal end wall of said latch and aligned with said socket of said lighter seat; (f) a coil spring disposed within said recess of said press-down button for biasing said latch to be butting against said lighter seat such that said protruding lock tongue of said spring biased latch engages with said socket of said lighter seat for preventing said press-down button from being pressed down; and (g) a thumb piece mounted on said top plate of said latch for facilitating the lateral sliding of said latch; (h) whereby when a user intends to use said cigarette lighter, said latch can be slid laterally against the spring force of said coil spring to disengage said protruding lock tongue of said latch from said socket of said lighter seat, thereby allowing said press-down button to be pressed down and ignite said cigarette lighter, and when the user releases said press-down button, it returns upwardly while said latch is biased back by said coil spring and said protruding lock tongue automatically engages with said socket of said lighter seat again, thereby locking said press-down button.

Defined broadly, the present invention is a cigarette lighter, comprising: (a) a case having a bottom end and a top end; (b) a lighter seat mounted on said top end of said case and having a protruding lock tongue integrally formed at one side of the lighter seat; (c) a press-down button mounted on said top end of said case and located adjacent to said lighter seat, the press-down button having a pair of opposite sidewalls, a distal end wall, a proximal end opening, and a recess located between the pair of opposite sidewalls; (d) a latch having a pair of opposite sidewalls, a proximal end wall and a top plate, the latch slidably mounted on top of said press-down button, where the pair of opposite sidewalls slidably engage with said pair of sidewalls of said press-down button, and the proximal end wall covers said proximal end opening of said press-down button; (e) said proximal end wall of said latch having a socket aligned with said protruding lock tongue of said lighter seat; (f) a coil spring disposed within said recess of said press-down button for biasing said latch to be butting against said lighter seat such that said socket of said latch engages with said protruding lock tongue of said lighter seat for preventing said press-down button from being pressed down; and (g) a thumb piece mounted on said top plate of said latch for facilitating the lateral sliding of said latch; (h) whereby when a user intends to use said cigarette lighter, said latch can be slid laterally against the spring force of said coil spring to disengage said socket of said latch from said protruding lock tongue of said lighter seat, thereby allowing said press-down button to be pressed down and ignite said cigarette lighter, and when the user releases said press-down button, it returns upwardly while said latch is biased back by said coil spring and said socket automatically engages with said protruding lock tongue of said lighter seat again, thereby locking said press-down button.

Defined more broadly, the present invention is a lighter, comprising: (a) a case; (b) a lighter seat attached to said case; (c) a button attached to said case and located adjacent to said lighter seat; (d) a latch slidably mounted on said button; and (e) means for biasing said latch to be locked to said lighter seat to prevent said button from being pressed down; (f) whereby when a user intends to use said lighter, said latch can be slid laterally to disengage said means, thereby allowing said button to be pressed down and ignite said lighter, and when the user releases said button, it returns upwardly while said latch is biased back by said means and said latch automatically engages with said lighter seat again, thereby locking said button.

Defined broadly, the present invention is a planar loudspeaker, comprising: (a) a single substantially planar diaphragm configured for reproduction of sound; (b) at least one first transducer mounted on the diaphragm and coupled to a first channel of a multi-channel sound source; (c) at least one second transducer mounted on the diaphragm and coupled to a second channel of the multi-channel sound source; and (d) the at least one first and at least one second transducers spaced and positioned on the diaphragm such that the diaphragm can reproduce sound from both the first and the second channels of the multi-channel sound source.

Defined alternatively, the present invention is a planar loudspeaker, comprising: (a) a single substantially planar diaphragm configured for reproduction of sound and having at least two regions; (b) at least one first transducer mounted on one of the at least two regions of the diaphragm and coupled to a first channel of a common multi-channel sound source; (c) at least one second transducer mounted on the one of the at least two regions of the diaphragm and coupled to a second channel of the common multi-channel sound source; (d) at least another first transducer mounted on another one of the at least two regions of the diaphragm and also coupled to the first channel of the common multi-channel sound source; (e) at least another second transducer mounted on the other one of the at least two regions of the diaphragm and also coupled to the second channel of the common multi-channel sound source; and (f) the at least one first and the at least one second transducers spaced and positioned on the one of the at least two regions of the diaphragm, and the at least other first and the at least other second transducers spaced and positioned on the other one of the at least two regions of the diaphragm, such that the one of the at least two regions of the diaphragm can reproduce sound from both the first and the second channels of the common multi-channel sound source, while the other one of the at least two regions of the diaphragm can also reproduce sound from both the first and the second channels of the common multi-channel sound source.

Also defined alternatively, the present invention is a planar loudspeaker, comprising: (a) a single substantially planar diaphragm configured for reproduction of sound and having at least two regions; (b) at least one first transducer mounted on one of the at least two regions of the diaphragm and coupled to a first channel of a multi-channel sound source; (c) at least one second transducer mounted on the one of the at least two regions of the diaphragm and coupled to a second channel of the multi-channel sound source; (d) at least another first transducer mounted on another one of the at least two regions of the diaphragm and coupled to a first channel of another multi-channel sound source; (e) at least another second transducer mounted on the other one of the at least two regions of the diaphragm and coupled to a second channel of the other multi-channel sound source; and (f) the at least one first and the at least one second transducers spaced and positioned on the one of the at least two regions of the diaphragm, and the at least other first and the at least other second transducers spaced and positioned on the other one of the at least two regions of the diaphragm, such that the one of the at least two regions of the diaphragm can reproduce sound from both the first and the second channels of the multi-channel sound source, while the other one of the at least two regions of the diaphragm can reproduce sound from both the first and the second channels of the other multi-channel sound source.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A cigarette lighter, comprising:

a. a case having a bottom end and a top end;

b. a lighter seat mounted on said top end of said case and having a protruding lock tongue integrally formed at one side of the lighter seat;

c. a press-down button mounted on said top end of said case and located adjacent to said lighter seat, the press-down button having a pair of opposite sidewalls and a distal end wall forming a recess with a proximal end opening, d. a latch having a pair of opposite sidewalls, a proximal end wall and a top plate, the latch slidably mounted on top of said press-down button, where the pair of opposite sidewalls slidably engage with said pair of sidewalls of said press-down button, and the proximal end wall covers said proximal end opening of said recess;

e. said proximal end wall of said latch having a socket aligned with said protruding lock tongue of said lighter seat;

f. a coil spring disposed within said recess of said press-down button for biasing said latch to butt against said lighter seat such that said protruding lock tongue of said lighter seat engages said socket of said latch for preventing said press-down button from being pressed down to accidentally ignite said lighter; and g. a thumb piece mounted on said top plate of said latch for facilitating the lateral sliding of said latch;

h. whereby when a user intends to use said cigarette lighter, said latch can be slid laterally against the spring force of said coil spring to disengage said protruding lock tongue of said lighter seat from said socket of said latch, thereby allowing said press-down button to be pressed down and ignite said cigarette lighter, and when the user releases said press-down button, it returns upwardly while said latch is biased back by said coil spring and said protruding lock tongue of said lighter seat automatically engages with said socket of said latch again, thereby locking said press-down button.

2. The cigarette lighter in accordance with claim 1 further comprising a cover hingeably attached to said case and located adjacent to said top end.

3. The cigarette lighter in accordance with claim 1 wherein said thumb piece is made of rubber material.

4. The cigarette lighter in accordance with claim 1 wherein said cigarette lighter is refillable.

5. A cigarette lighter, comprising:

a. a case having a bottom end and a top end;

b. a lighter seat mounted on said top end of said case and having a socket integrally formed at one side of the lighter seat;

c. a press-down button mounted on said top end of said case and located adjacent to said lighter seat, the press-down button having a pair of opposite sidewalls and a distal end wall forming a recess with a proximal end opening, d. a latch having a pair of opposite sidewalls, a proximal end wall and a top plate, the latch slidably mounted on top of said press-down button, where the pair of opposite sidewalls slidably engage with said pair of sidewalls of said press-down button, and the proximal end wall covers said proximal end opening of said recess;

e. a protruding lock tongue integrally formed on said proximal end wall of said latch and aligned with said socket of said lighter seat;

f. a coil spring disposed within said recess of said press-down button for biasing said latch to butt against said lighter seat such that said protruding lock tongue of said latch engages said socket of said lighter seat for preventing said press-down button from being pressed down to accidentally ignite said lighter; and g. a thumb piece mounted on said top plate of said latch for facilitating the lateral sliding of said latch;

h. whereby when a user intends to use said cigarette lighter, said latch can be slid laterally against the spring force of said coil spring to disengage said protruding lock tongue of said latch from said socket of said lighter seat, thereby allowing said press-down button to be pressed down and ignite said cigarette lighter, and when the user releases said press-down button, it returns upwardly while said latch is biased back by said coil spring and said protruding lock tongue of said latch automatically engages with said socket of said lighter seat again, thereby locking said press-down button.

6. The disposable cigarette lighter in accordance with claim 5 further comprising a cover hingeably attached to said case and located adjacent to said top end.

7. The disposable cigarette lighter in accordance with claim 5 wherein said thumb piece is made of rubber material.

8. The cigarette lighter in accordance with claim 5 wherein said cigarette lighter is refillable.

9. A lighter, comprising:

a. a case having a lighter seat attached thereto;

b. a depressable button attached to said case and located adjacent to said lighter seat;

c. a latch movably mounted on said button;

d. means for locking said latch to said lighter seat to prevent said button from being pressed down; and e. mean for releasing said latch from said lighter seat to allow said button from being pressed down to ignite said lighter.

10. The lighter in accordance with claim 9 further comprising a cover hingeably attached to said case and covering said lighter seat, said button and said latch.

11. The lighter in accordance with claim 9 further comprising a thumb piece mounted on said latch for facilitating the moving of said latch.

12. The lighter in accordance with claim 11 wherein said thumb piece is made of rubber material.

13. The lighter in accordance with claim 9 wherein said locking means comprises a protruding lock tongue integrally formed on said lighter seat and a complementary socket integrally formed on said latch.

14. The lighter in accordance with claim 9 wherein said locking means comprises a protruding lock tongue integrally formed on said latch and a complementary socket integrally formed on said lighter seat.

15. The lighter in accordance with claim 9 further comprising means for biasing said latch towards said lighter seat.

16. The lighter in accordance with claim 15 wherein said biasing means comprises a coil spring disposed within said button.

17. The lighter in accordance with claim 9 wherein said lighter is refillable.

* * * * *